US008585164B2

(12) United States Patent
Chen et al.

(10) Patent No.: US 8,585,164 B2
(45) Date of Patent: Nov. 19, 2013

(54) LOCKING MECHANISM OF SLIDE ASSEMBLY

(75) Inventors: Ken-Ching Chen, Kaohsiung Hsien (TW); Hsueh-Lung Liu, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 243 days.

(21) Appl. No.: 13/151,320

(22) Filed: Jun. 2, 2011

(65) Prior Publication Data

US 2012/0308297 A1 Dec. 6, 2012

(51) Int. Cl.
*A47B 95/00* (2006.01)

(52) U.S. Cl.
USPC ..... 312/333; 312/334.46

(58) Field of Classification Search
USPC ..... 312/333, 334.44–334.47
See application file for complete search history.

(56) References Cited

U.S. PATENT DOCUMENTS

| | | | | |
|---|---|---|---|---|
| 6,749,276 | B2 * | 6/2004 | Judge et al. | 312/334.47 |
| 6,945,619 | B1 * | 9/2005 | Chen et al. | 312/334.47 |
| 7,357,468 | B2 * | 4/2008 | Hwang et al. | 312/333 |
| 7,404,611 | B1 * | 7/2008 | Que | 312/334.46 |
| 7,448,704 | B2 * | 11/2008 | Lam et al. | 312/333 |
| 7,658,457 | B2 * | 2/2010 | Lu | 312/334.47 |
| 7,878,606 | B2 * | 2/2011 | Chen et al. | 312/333 |
| 2004/0080245 | A1 * | 4/2004 | Lammens et al. | 312/333 |
| 2005/0248247 | A1 * | 11/2005 | Huang | 312/334.47 |
| 2008/0124009 | A1 * | 5/2008 | Peng et al. | 384/21 |
| 2008/0197758 | A1 * | 8/2008 | Mushan et al. | 312/334.1 |
| 2009/0001864 | A1 * | 1/2009 | Huang et al. | 312/333 |

* cited by examiner

*Primary Examiner* — Darnell Jayne
*Assistant Examiner* — Andres F Gallego
(74) *Attorney, Agent, or Firm* — Rosenberg, Klein & Lee

(57) ABSTRACT

A locking mechanism of a slide assembly includes a first rail with a first stop connected thereto, a locking member movably connected to a second rail which is slidably connected to the first rail. The second rail has a slide slot and a contact slot. The locking member has a guide slot and a positioning leg contacting an inside of the contact slot. The guide slot is an inclined slot and located relative to the slide slot of the second rail. A pin is movably connected to the slide slot and a part of the pin is located in the guide slot. The locking member is moved and the pin is guided by the guide slot and moves along the slide slot to a locked position where the pin is engaged with the first stop to lock the second rail to the first rail.

3 Claims, 5 Drawing Sheets

LOCKING MECHANISM OF SLIDE ASSEMBLY

FIELD OF THE INVENTION

The present invention relates to a locking mechanism of a slide assembly, and more particularly, to a locking mechanism for locking the first and second rails while the second rail is not moved with pull-out movement of the third rail.

BACKGROUND OF THE INVENTION

Taiwan Patent No. 1271168 discloses a positioning mechanism for a slide assembly which is granted as U.S. Pat. No. 7,357,468, and generally includes a mediate rail and an inner rail which is simultaneously pulled out with the mediate rail. When the mediate rail is positioned relative to an outer rail, the inner rail is disengaged from the mediate rail and extended completely. When retracting the slide assembly, the inner rail and the mediate rail are retracted to the outer rail in sequence.

However, the second rail (mediate rail) cannot be locked relative to the first rail (outer rail) at the retracted status, and the second rail (mediate rail) cannot be unlocked individually and pulled with the third rail (inner rail). When the slide assembly is cooperated with a drawer or installed to a cabinet, the first rail (outer rail) is installed to the cabinet and connected to the second rail (mediate rail), and the third rail (inner rail) is connected with the drawer. The third rail (inner rail) is inserted to be connected or disengaged from the slide assembly relative to the second rail (mediate rail). When the third rail (inner rail) is to be disengaged from the second rail (mediate rail) to remove the drawer from the cabinet, the first action is to pull the third rail (inner rail) and the second rail (mediate rail) simultaneously from the first rail (outer rail), so that a part of the second rail (mediate rail) is pulled from the first rail (outer rail), and then, the third rail (inner rail) is completely pulled from the second rail (mediate rail). During the disengaging processes, the depth of the operation space has to be larger than the full length of the third rail (inner rail) plus the extended length of the second rail (mediate rail). When the space where a cabinet is placed is not enough to extend the third rail (inner rail) and the second rail (mediate rail), the kind of slide assembly is unsuitable for being used to the cabinet.

Accordingly, another slide assembly is needed to meet the requirement mentioned above.

SUMMARY OF THE INVENTION

The present invention relates to a locking mechanism of a slide assembly and comprises a first stop connected to a first rail and the first stop has a wall. A locking member is movably connected to a second rail which is slidably connected to the first rail. The second rail has a slide slot and a contact slot, and the locking member has an operation portion, a guide slot and a positioning leg which contact the inside of the contact slot. The guide slot is an inclined slot relative to the slide slot of the second rail. A pin is movably connected to the slide slot of the second rail and a part of the pin is located in the guide slot of the locking member. The locking member is moved by operation of the operation portion. The pin is guided by the inclined guide slot and movable along the slide slot so as to be located at a locked position and corresponding to the first stop. The pin is engaged with the wall of the first stop to lock the second rail to the first rail.

Preferably, a third rail is slidably connected to the second rail and a synchronization member is pivotably connected to the second rail. The second rail has an opening to accommodate the synchronization member. A resilient member is fixed to the second rail. The synchronization member comprises a first end, a second end and a mediate portion which is located between the first and second ends. The first end has a latch and the resilient member biases the second end of the synchronization member so that the latch of the first end of the synchronization member constantly protrudes above the opening of the second rail. The locking member has a release portion located relative to the latch so that the latch is moved by the release portion of the locking member and inserted into the opening of the second rail.

Preferably, the third rail has a second stop which is located corresponding to the latch of the synchronization member. The second stop is engaged with the latch while the latch of the synchronization member constantly protrudes above the opening of the second rail.

Preferably, the contact slot has a first recess and a second recess defined in the inside thereof, the locking member is shifted by the positioning leg engaged with one of the first and second recesses.

Preferably, the second rail has a pair of fixing holes and the locking member has a pair of elongate slots which are located corresponding to the fixing holes of the second rail. Two fixing pins respectively extend through the elongate slots and are fixed to the fixing holes.

One object of the present invention is to provide a locking mechanism of a slide assembly which controls the two rails of multi-rail slide assembly to be locked and released.

Another object of the present invention is to provide a locking mechanism of a slide assembly which controls the two rails of multi-rail slide assembly to be locked at the retracted status, and the other rail of multi-rail slide assembly can be individually pulled and disengaged form the two rails so that the slide assembly can be installed within a limited space.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
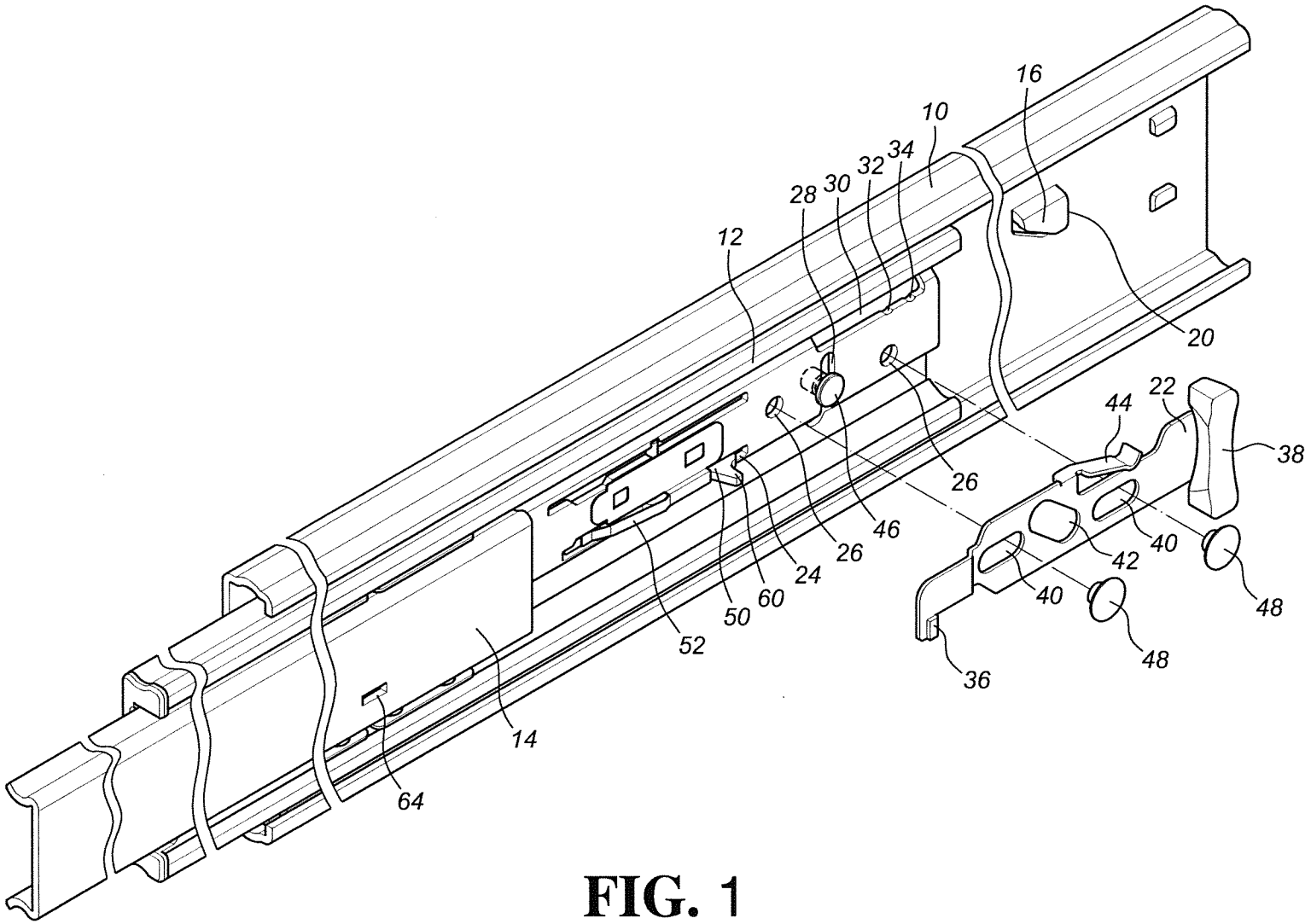
FIG. 1 is an exploded view to show the slide assembly and the locking member of the present invention.

As shown in FIG. 1, the slide assembly comprises a first rail 10, a second rail 12 slidably connected to the first rail 10, a third rail 14 longitudinally and slidably connected to the second rail 12, and a locking mechanism.

The locking mechanism comprises a first stop 16, a locking member 22, and a pin 46. The first stop 16 is connected to the first rail 10 and has a wall 20. The locking member 22 is movably connected to the second rail 12 which has an opening 24, a pair of fixing holes 26, a slide slot 28 and a contact slot 30. The contact slot 30 has a first recess 32 and a second recess 34 defined in the inside thereof. The locking member 22 has a release portion 36 and an operation portion 38 respectively on the front and rear ends thereof. A pair of elongate slots 40 are located between the release portion 36 and the operation portion 38, and the pair of elongate slots 40 are located corresponding to the fixing holes 26 of the second rail 12. A guide slot 42 is located relative to the slide slot 28 of the second rail 12. A positioning leg 44 is located corresponding to the contact slot 30 and contacting the inside of the contact slot 30. Preferably, the guide slot 42 is an inclined slot.

The locking member 22 is shifted by the positioning leg 44 engaged with one of the first and second recesses 32, 34.

The pin 46 is movably connected to the slide slot 28 of the second rail 12 and a part of the pin 46 is located in the guide slot 42 of the locking member 22.

The pin 46 is operated by the locking member 22 and guided by the inclined guide slot 42 and movable along the slide slot 28 so as to be located at a locked position and corresponding to the first stop 16. The pin 46 is engaged with the wall 20 of the first stop 16 to lock the second rail 12 to the first rail 10.

Preferably, the locking member 22 is secured by respectively extending two fixing pins 48 through the elongate slots 40 of the locking member 22 and fixed to the fixing holes 26 of the second rail 12.

Figure 2:
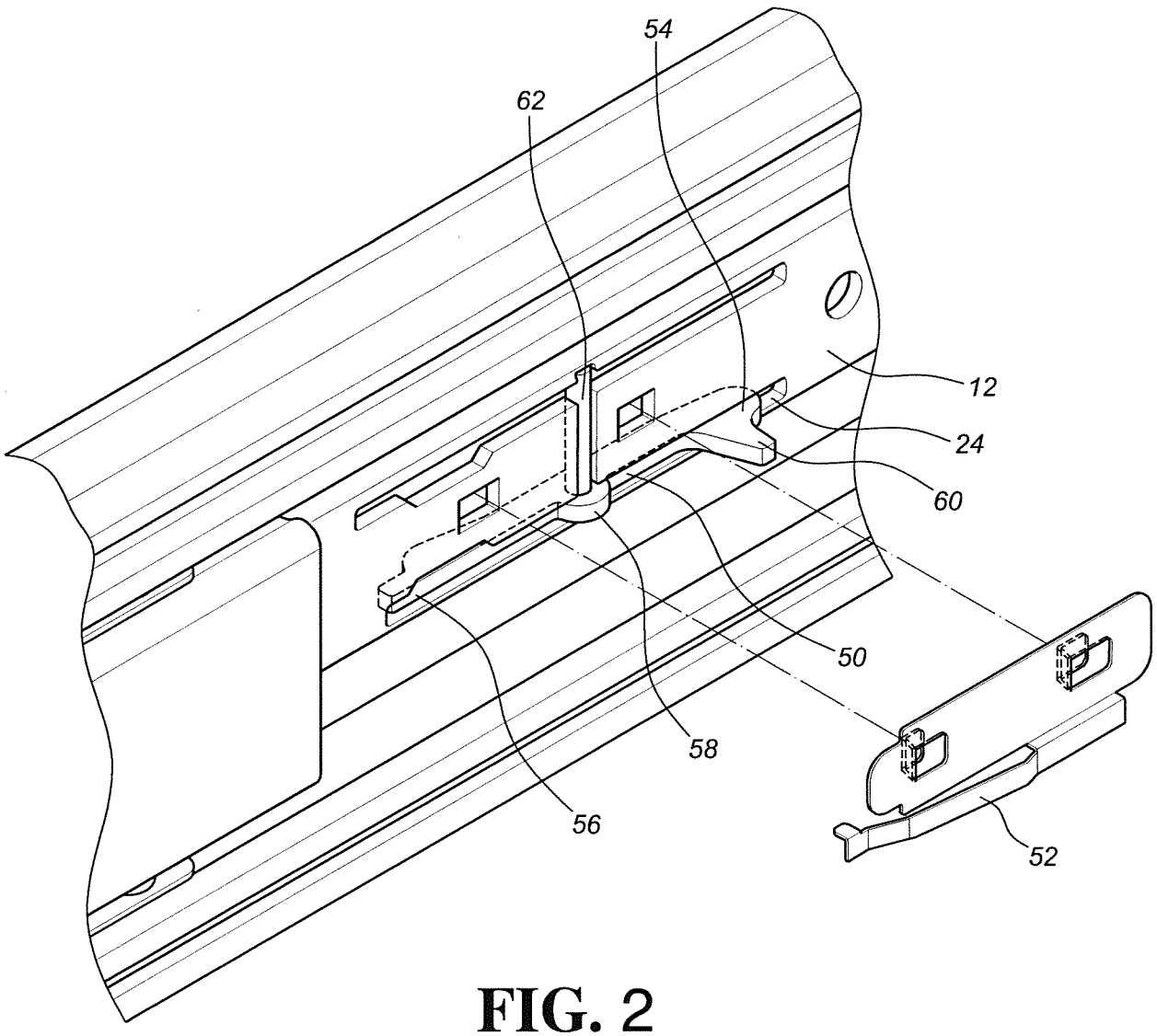
FIG. 2 shows that the synchronization member is to be connected to the slide assembly.
Figure 3:
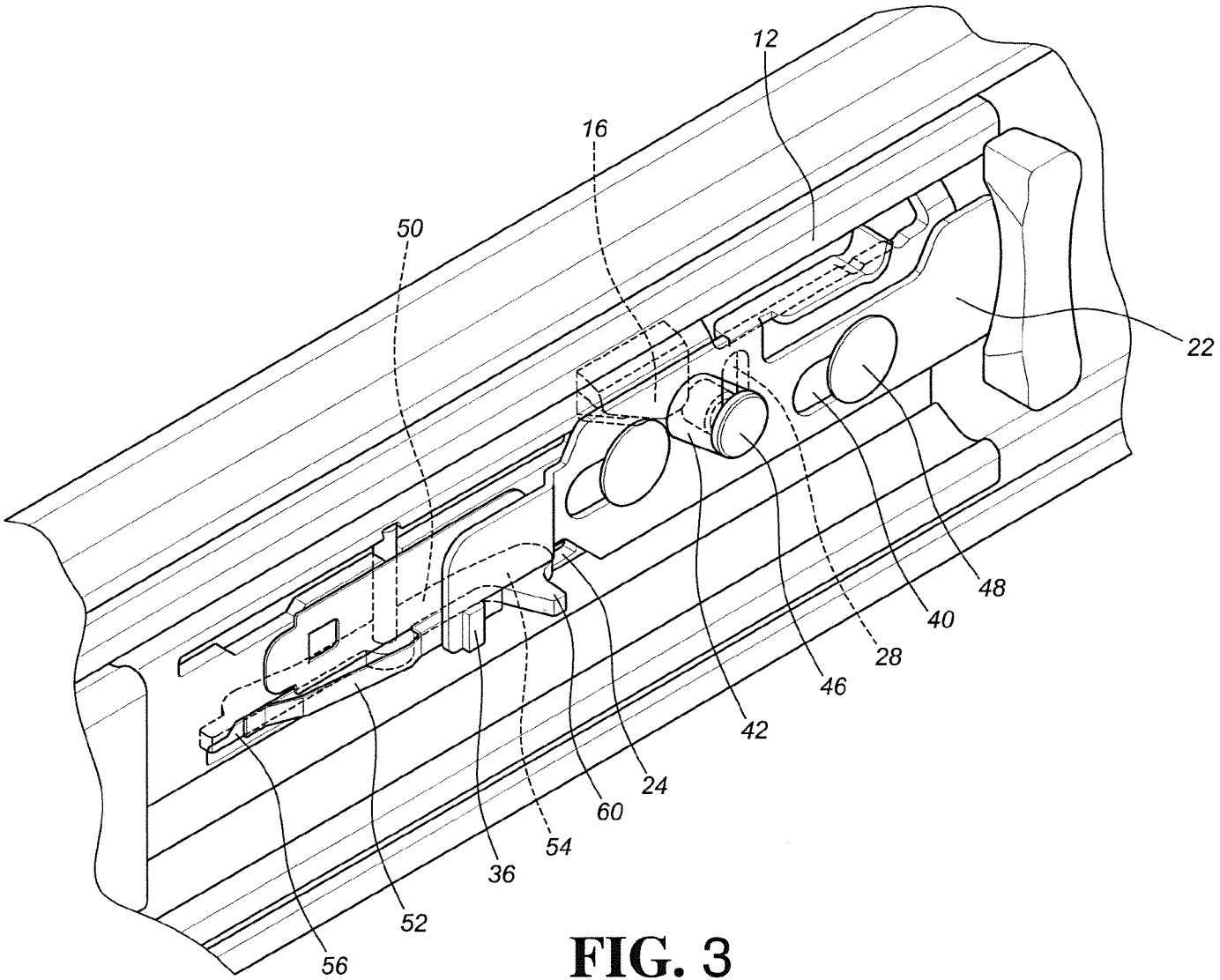
FIG. 3 is a perspective view to show that the synchronization member and the locking member are connected to the second rail.

In a preferable embodiment, a synchronization member 50 is pivotably connected to the second rail 12, and the second rail 12 has the opening 24 to accommodate the synchronization member 50. A resilient member 52 is fixed to the second rail 12. As shown in FIGS. 2 and 3, the synchronization member 50 comprises a first end 54, a second end 56 and a mediate portion 58 which is located between the first and second ends 54, 56. The first end 54 has a latch 60 and a pivot 62 extends through the mediate portion 58 to pivotaby connect the synchronization member 50 to the second rail 12. The resilient member 52 biases the second end 56 of the synchronization member 50 so that the latch 60 of the first end 54 of the synchronization member 50 constantly protrudes above the opening 24 of the second rail 12. The locking member 22 has the release portion 36 located relative to the latch 60.

As shown in FIG. 1, the third rail 14 has a second stop 64 which is located corresponding to the latch 60 of the synchronization member 50. The second stop 64 is engaged with the latch 60 while the latch 60 of the synchronization member 50 constantly protrudes above the opening 24 of the second rail 12. In this status, the second rail 12 can be pulled by the pull-out action of the third rail 14 as shown in FIG. 5.

Figure 4:
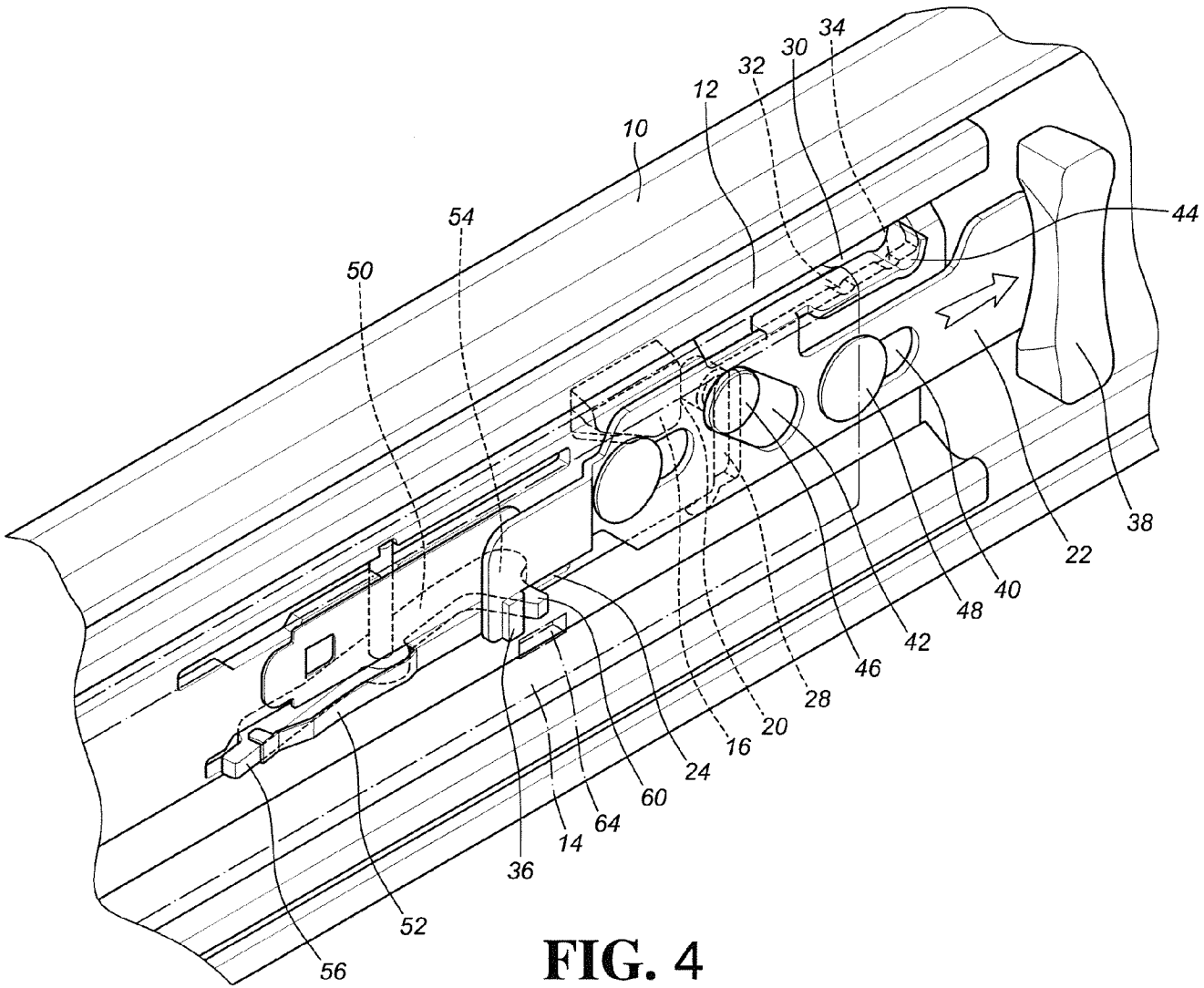
FIG. 4 shows that the second rail is locked relative to the first rail when in a retracted status.

As shown in FIG. 4, the second rail 12 is retracted relative to the first rail 10 and is locked by the locking mechanism. The locking action is achieved by operation to the operation portion 38 of the locking member 22, so that the positioning leg 44 of the locking member 22 is shifted from the first recess 32 of the contact slot 30 of the second rail 12 to the second recess 34. The pin 46 is guided by the guide slot 42 of the locking member 22 to move along the slide slot 28 of the second rail 12 so as to move to a locked position and is located corresponding to the first stop 16. The pin 46 is engaged with the wall 20 of the first stop 16 such that the second rail 12 is locked to the first rail 10. In the meanwhile, the latch 60 of the first end 54 of the synchronization member 50 is moved by the release portion 36 of the locking member 22 and inserted into the opening 24 of the second rail 12. The latch 60 is then disengaged from the second stop 64 of the third rail 14. Therefore, the third rail 14 can be individually pulled out and the second rail 12 does not move with the third rail 14. The second rail 12 is locked to the first rail 10.

Figure 5:
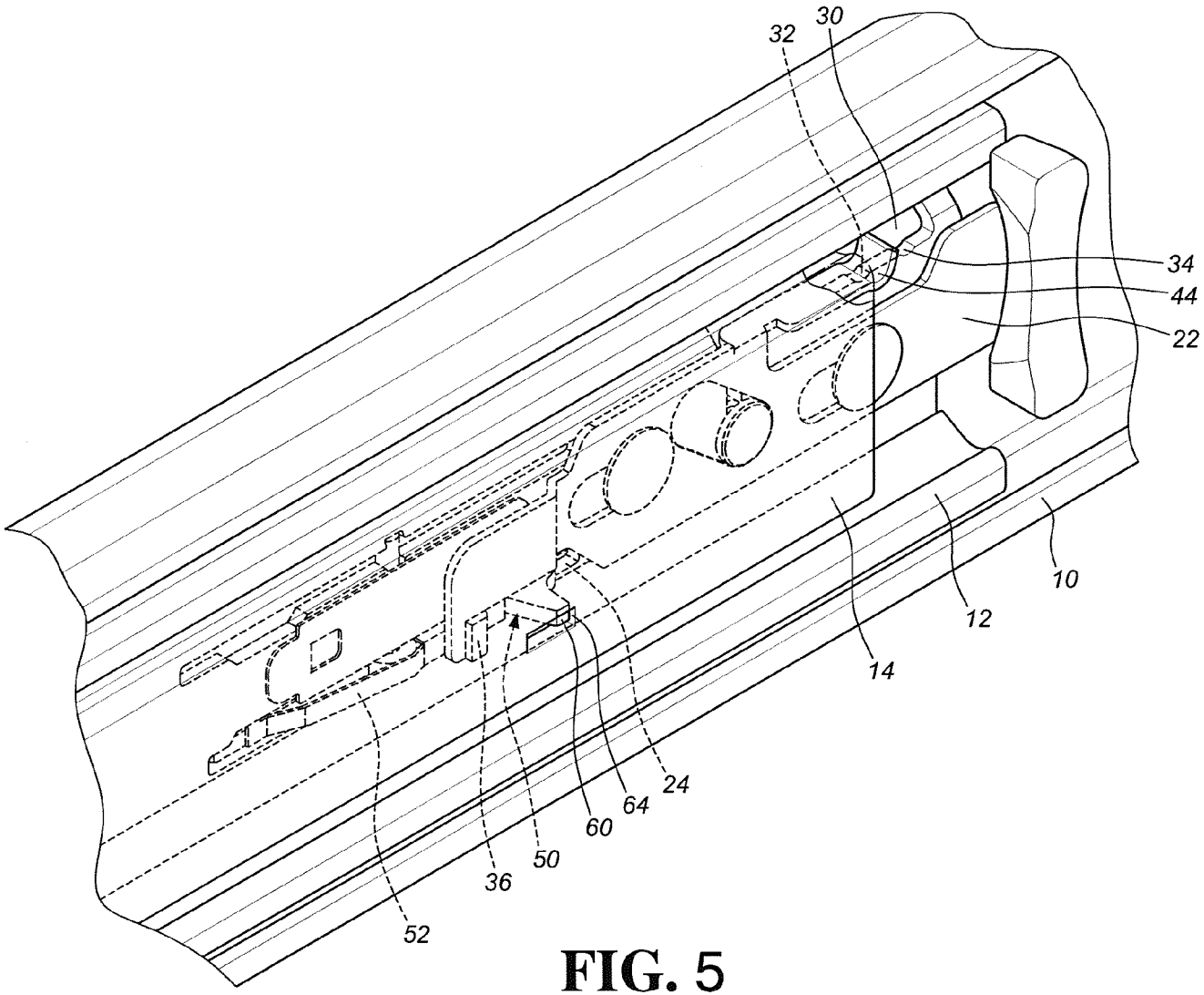
FIG. 5 shows that the second rail is unlocked relative to the first rail and the second and third rails are moved simultaneously.

When the third and second rails 14, 12 are to be simultaneously pulled out from the first rail 10, as shown in FIG. 5, the locking member 22 is pushed back to allow the positioning leg 44 contact the first recess 32 of the contact slot 30, so that the release portion 36 of the locking member 22 is released from the latch 60 of the synchronization member 50. The latch 60 of the synchronization member 50 returns to the position where it protrudes above the opening 24 of the second rail 12 by the force of the resilient member 52 and contacts the second stop 64 of the third rail 14. When the third rail 14 is pulled out, the second rail 12 is pulled simultaneously with the third rail 14.

The locking mechanism of the present invention contacts the three-rail slide assembly wherein the first and second rails are locked at the retracted position, and the second rail can be unlocked so that the second rail does not move with the pull-out action of the third rail. By the invention, the slide assembly is suitable for installation in a limited space such as the electronic equipments installed in a machine room, wherein the limited space does not have sufficient depth and conventional three-rail slide assembly cannot be pulled completely to be disengaged from the machine room, or where only a part of the slide assembly is needed to be accessed when in maintenance.

While we have shown and described the embodiment in accordance with the present invention, it should be clear to those skilled in the art that further embodiments may be made without departing from the scope of the present invention.

What is claimed is:

1. A locking mechanism of a slide assembly, comprising:

a first rail having a first stopping portion, a second rail slidably coupled to the first rail and a third rail slidably coupled to the second rail and having a second stopping portion, the first stopping portion having a wall formed on one side thereof, the second rail having a slide slot and a contact slot formed therein;

a locking member movably connected to the second rail, the locking member having an operation portion, a guide slot and a positioning leg contacting an inside surface of the contact slot, the guide slot being disposed in correspondence to the slide slot of the second rail and being inclined relative thereto;

a pin movably connected to the slide slot of the second rail and a part of the pin extending into the guide slot of the locking member;

a resilient member affixed to the second rail; and a synchronization member pivotally connected to the second rail, the synchronization member including a first end, a second end and a mediate portion located between the first and second ends, the first end having a latch disposed in aligned relationship with an opening formed through the second rail, the resilient member biasing the synchronization member to protrude the latch of the first end of the synchronization member through the opening in the second rail and thereby engageable with the second stopping portion of the third rail, the locking member having a release portion located in proximity to the latch;

wherein, the locking member is movable by operation of the operation portion to a first locking position and the pin is thereby guided by the inclined guide slot and movable along the slide slot to engage the wall of the first stopping portion to lock the second rail to the first rail and displace the release portion to displace the latch away from the opening in the second rail and disengagement of the latch from the second stopping portion of the third rail to release the third rail to move freely with respect to the second rail, the locking member being movable by operation of the operation portion to a second locking position and thereby disengage the pin from the wall of the first stopping portion to release the second rail to move freely with respect to the first rail and displace the release portion to allow the bias of the resilient member to move the latch through the opening in the second rail and engage the second stopping portion of the third rail to lock the third rail to the second rail for concurrent movement therewith.

2. The locking mechanism as claimed in claim 1, wherein the contact slot has a first recess and a second recess defined in the inside surface thereof to respectively correspond to the second locking position and the first locking position, the locking member being moved to one of the second and first locking positions in correspondence with the positioning leg being engaged with one of the first and second recesses.

3. The locking mechanism as claimed in claim 1, wherein the second rail has a pair of fixing holes and the locking member has a pair of elongate slots which are located corresponding to the fixing holes of the second rail, two fixing pins respectively extend through the elongate slots and are fixed to the fixing holes.

* * * * *